US008677656B2

(12) United States Patent
Nishiwaki et al.

(10) Patent No.: US 8,677,656 B2
(45) Date of Patent: Mar. 25, 2014

(54) ATHLETIC SHOE WITH HEEL COUNTER FOR MAINTAINING SHAPE OF HEEL SECTION

(75) Inventors: Tsuyoshi Nishiwaki, Hyogo (JP); Kenta Moriyasu, Hyogo (JP); Seigo Nakaya, Hyogo (JP); Kiyomitsu Kurosaki, Hyogo (JP)

(73) Assignee: Asics Corporation, Hyogo (JP)

( * ) Notice: Subject to any disclaimer, the term of this patent is extended or adjusted under 35 U.S.C. 154(b) by 570 days.

(21) Appl. No.: 13/120,499

(22) PCT Filed: Sep. 30, 2008

(86) PCT No.: PCT/JP2008/067723

§ 371 (c)(1),
(2), (4) Date: Apr. 22, 2011

(87) PCT Pub. No.: WO2010/038267

PCT Pub. Date: Apr. 8, 2010

(65) Prior Publication Data

US 2011/0185592 A1 Aug. 4, 2011

(51) Int. Cl.
*A43B 23/08* (2006.01)

(52) U.S. Cl.
USPC ..... 36/69; 36/93

(58) Field of Classification Search
USPC ..... 36/68, 69, 88, 93
See application file for complete search history.

(56) References Cited

U.S. PATENT DOCUMENTS 912,579 A * 2/1909 Krech et al. ..... 36/58.5
1,176,198 A * 3/1916 Britts ..... 36/68
1,972,899 A * 9/1934 Odell ..... 36/140
2,080,959 A * 5/1937 Cobb ..... 36/68
2,261,453 A * 11/1941 Reinhart et al. ..... 36/89

(Continued)

FOREIGN PATENT DOCUMENTS

JP 52-104454 8/1977
JP 64-008904 A 1/1989

(Continued)

OTHER PUBLICATIONS

International Search Report for corresponding International Application No. PCT/JP2008/067723 mailed Dec. 22, 2008.

*Primary Examiner* — Marie Bays
(74) *Attorney, Agent, or Firm* — Renner, Otto, Boisselle & Sklar, LLP

(57) ABSTRACT

A heel counter 4 includes: a support section 43 extending in a forward direction from a back side 1*b* of an upper 1; a rib 40 extending in the forward direction generally in parallel to the support section 43 at a position above the support section 43 from the back side 1*b* of the upper 1 along a medial side 11 and extending in the forward direction generally in parallel to the support section 43 at a position above the support section 43 from the back side 1*b* of the upper 1 along a lateral side 12; and first and second bridge means 41*a*, 41*b* and 42 connecting the support section 43 and the rib 40 to each other allowing the support section 43 to support the rib 40, wherein: a foremost one 46*b* of a plurality of connection portions 46*b*, 46*c* and 46*e* by which the rib 40 and the bridge means 41*a*, 41*b* and 42 are connected to each other is provided on the medial side of the upper 1; and the foremost connection portion 46*b* is located forward of a rear end of a talus bone B8.

10 Claims, 13 Drawing Sheets

(56) References Cited

U.S. PATENT DOCUMENTS

| | | | | | |
|---|---|---|---|---|---|
| 2,348,300 | A | * | 5/1944 | Klaus | 36/154 |
| 4,821,430 | A | * | 4/1989 | Flemming et al. | 36/69 |
| 5,152,082 | A | * | 10/1992 | Culpepper | 36/89 |
| 5,317,820 | A | * | 6/1994 | Bell et al. | 36/89 |
| 5,408,761 | A | * | 4/1995 | Gazzano | 36/88 |
| 6,000,148 | A | * | 12/1999 | Cretinon | 36/88 |
| 8,555,529 | B2 | * | 10/2013 | Antonelli et al. | 36/68 |

FOREIGN PATENT DOCUMENTS

| | | | |
|---|---|---|---|
| JP | 2-61202 | U | 5/1990 |
| JP | 2-503271 | A | 10/1990 |
| JP | 3-34089 | Y2 | 7/1991 |
| JP | 2002-262907 | | 9/2002 |
| JP | 2008-206629 | | 9/2008 |
| WO | 88/08678 | | 11/1988 |

* cited by examiner

ATHLETIC SHOE WITH HEEL COUNTER FOR MAINTAINING SHAPE OF HEEL SECTION

TECHNICAL FIELD

The present invention relates to an athletic shoe with a heel counter for maintaining a shape of a heel section.

BACKGROUND ART

A heel counter covers the opposing side surfaces and the back surface of the heel and maintains the shape of the heel section of the upper. If the entire heel is wrapped by a heel counter formed by a resin part, the heel section of the upper has a high rigidity, but it inhibits the deformation of the upper in conformity to the shape of the heel of the wearer. In other words, it lowers the fit around the heel section.

For example, a heel counter with a rib extending along the opening is known in the art as listed below.

[First Patent Document] Japanese Laid-Open Utility Model Publication No. S52-104454 (FIG. 2)

[Second Patent Document] Japanese Laid-Open Utility Model Publication No. H02-061202 (FIG. 5)

[Third Patent Document] Japanese Laid-Open Patent Publication No. S64-008904 (FIG. 11)

[Fourth Patent Document] Japanese Utility Model Publication for Opposition No. H03-034089 (FIG. 1)

For example, a heel counter formed in a grid (meshed) pattern with through holes is known in the art, as disclosed in the following patent document.

[Fifth Patent Document] WO88/08678 (FIG. 5)

DISCLOSURE OF THE INVENTION

During a run, a foot lands starting from the outer side of the heel, and then the center of the load moves to the inner side of the front foot portion. The heel pronates in this process, and suppressing excessive pronation is useful in preventing foot injuries during running.

On the other hand, with ordinary runners, it is unlikely that the heel supinates immediately after landing.

However, the heel counters disclosed in the above publications fail to give any consideration as to the difference between pronation (heel eversion) and supination (heel inversion) of the heel.

An object of the present invention is to provide an athletic shoe that is useful in preventing excessive pronation and yet does not inhibit necessary outward movements of the heel.

In order to achieve the object above, the present invention provides an athletic shoe with a novel heel counter.

An athletic shoe in one aspect of the present invention is an athletic shoe with a heel counter for maintaining a shape of a heel section of an upper, wherein: the upper is formed by layering together a plurality of layers of a material; the upper includes a medial side covering a medial surface of a foot, a lateral side covering a lateral surface of the foot, a back side covering a back surface of the foot, and an opening defined by upper edges of the medial side, the lateral side and the back side; in a vicinity of the opening of the upper, the medial side of the upper covers a front end portion of a talus bone and a front end portion of a subtalar joint, and the lateral side of the upper covers the front end portion of the talus bone and the front end portion of the subtalar joint; the heel counter is formed as an integral synthetic resin part, the heel counter comprising: a support section extending in a forward direction of the foot along a lower edge of the medial side of the upper from the back side of the upper to a position forward of a rear end of the talus bone, and extending in the forward direction along a lower edge of the lateral side of the upper from the back side of the upper to a position forward of the rear end of the talus bone; a rib extending in the forward direction along the medial side generally in parallel to the support section at a position above the support section from the back side of the upper to a position forward of a position directly under a rear end of a medial malleolus, and extending in the forward direction along the lateral side generally in parallel to the support section at a position above the support section from the back side of the upper to a position forward of the rear end of the talus bone; one or more first bridge means provided on the medial side so as to bridge between the support section and the rib; and one or more second bridge means provided on the back side or the lateral side so as to bridge between the support section and the rib, the rib is supported by the support section via the first bridge means on the medial side, the rib is supported by the support section via the second bridge means on the back side or the lateral side, wherein: each of the bridge means, the support section and the rib form through holes therebetween through which the upper is exposed; a foremost one of a plurality of connection portions by which the rib and each of the bridge means are connected to each other is provided on the medial side of the upper; and a front end of the foremost connection portion is located forward of a position directly under the rear end of the medial malleolus.

The rib and the first and second bridge means of the heel counter maintain the shape of the heel section of the upper.

The heel counter is formed in a lattice pattern with the support section, the rib and the bridge means. Therefore, it is unlikely that the deformation of the upper in conformity with the shape of the heel of the foot is inhibited.

Note that to "extend to a position forward (frontward) of the rear end of the talus bone" includes a case where the rib extends to a position forward of the position directly under the talus bone without passing by the rear end of the talus bone, as well as a case where the rib extends to the position forward of the rear end of the talus bone passing by the rear end of the talus bone, on the medial side and the lateral side of the upper.

Particularly, on the medial side of the foot, the front end of the foremost connection portion is provided forward of the rear end of the medial malleolus, and the rib is connected to and supported by the support section via the first bridge means. Therefore, the front portion of the opening of the upper reinforced by the rib is less likely to be opened. This suppresses the foot falling in the medial direction to thereby suppress the pronation of the heel.

An advantage of such first bridge means is more clearly understood when a load from above acts upon the upper edge of the opening in which case the first bridge means bridging between the rib and the support section suppresses the vertical deformation of the upper on the medial side of the upper.

On the other hand, on the lateral side or the back side of the foot, the rib is connected to the second bridge means at a position more rearward than on the medial side. Therefore, necessary movements of the foot in the lateral direction are unlikely to be inhibited.

The material of the upper may be fabric such as leather, synthetic leather or artificial leather, as well as fibrous fabric such as woven fabric, knit or non-woven fabric, and the material of the upper may be partially single-layered.

In a preferred embodiment of the present invention, the rib on the back side covers a back side of an upper portion of a calcaneal bone, and the rib on the medial side and the lateral side extends toward a lower end of the talus bone.

In another preferred embodiment, the rib on the medial side and the lateral side covers a portion of a calcaneal bone in a vicinity of the subtalar joint.

In such a case, with the rib covering a portion of the side surface of the subtalar joint or the calcaneal bone in the vicinity thereof, it is possible to suppress the opening being widened in the medial-lateral direction. Thus, the upper fits the heel of the foot.

In such a case, in a more preferred embodiment, a front end of the rib or a vicinity thereof is connected to the first bridge means on the medial side, and the rib is supported by the support section via the first bridge means.

The rib is supported by the support section via the first bridge means below the medial malleolus. Thus, it is possible to reliably obtain the effect of suppressing the foot falling in the medial direction upon landing.

In a more preferred embodiment, a medial-side front end of the rib is located forward compared to a lateral-side front end of the rib.

In still another preferred embodiment, the heel counter further includes a sandwiched portion connected to the support section and sandwiched between the upper and a shoe sole.

Therefore, where the sandwiched portion is sandwiched between the upper and the shoe sole, the heel counter is stably secured to the sole. Thus, it is easy with the rib to maintain the shape of the opening of the upper. This enhances the effect of suppressing the foot pronation.

In such a case, in a more preferred embodiment, on the medial side and the lateral side, a front end of the support section is located forward of a front end of the calcaneal bone and is located forward of the front end of the rib.

Thus, in a case where the support section extends to a position forward of the rib, the heel counter is more stably supported by the sole via the support section.

In a preferred embodiment of the present invention, the medial-side and lateral-side upper edges of the upper forming the opening are each formed of a first edge slanted upwardly as it extends in a forward direction from a middle point of the opening in a front-rear direction and a second edge slanted upwardly as it extends in a rearward direction from the middle point, the first edge and second edge are connected together; and a medial-side front end of the rib is located forward of the middle point and rearward of the front end of the talus bone.

With the rib extending to the middle point or to a position forward of the middle point, it is possible to suppress the foot falling in the medial direction.

DESCRIPTION OF THE REFERENCE NUMERALS

Figure 1:
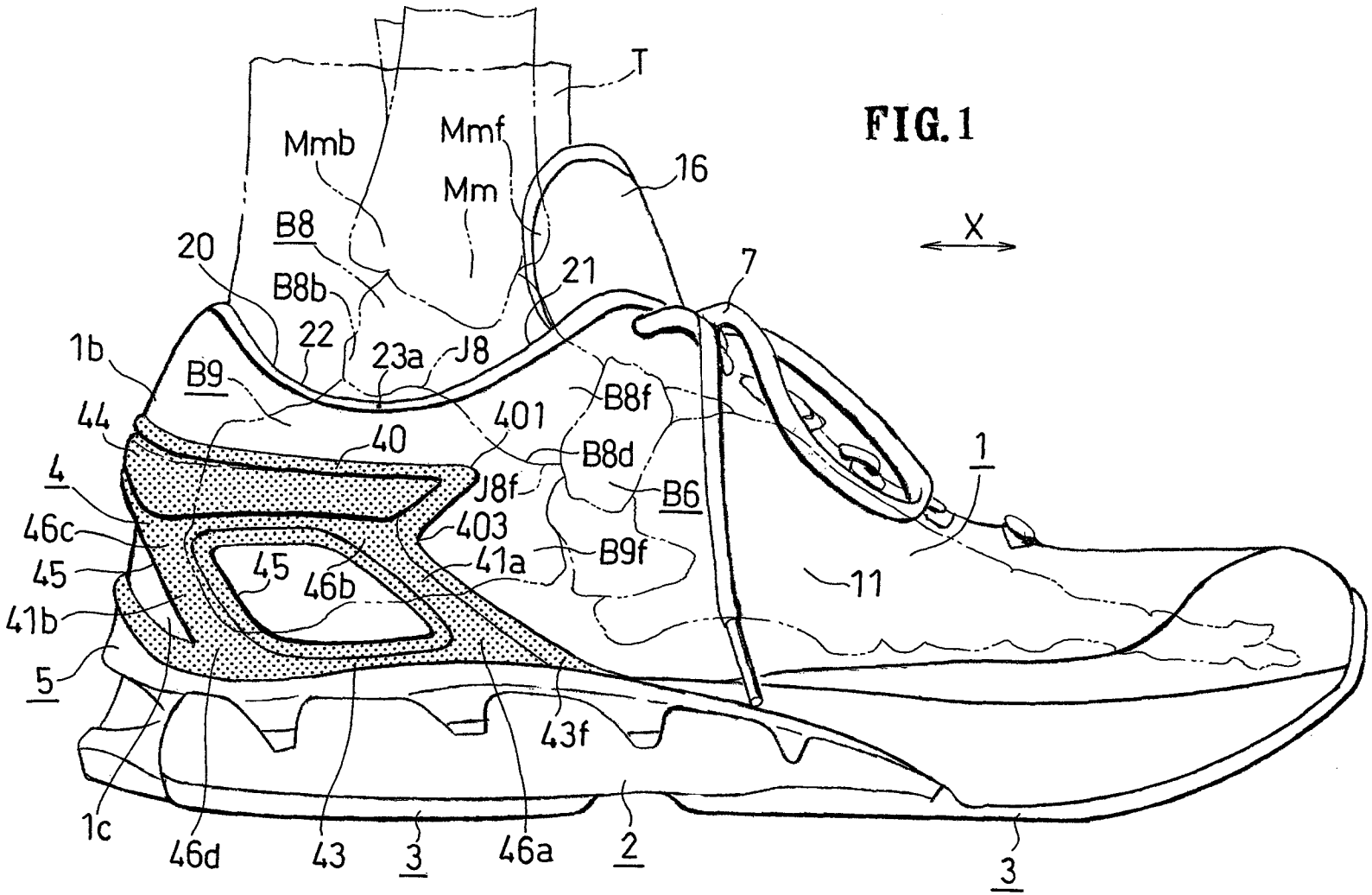
FIG. 1 is a medial side view showing an athletic shoe of Embodiment 1 of the present invention.

1: Upper
1*d*: Heel section
4: Heel counter
11: Medial side
12: Lateral side
20: Opening
21: First edge
22: Second edge
23*a*: Medial-side middle point
23*b*: Lateral-side middle point
40: Rib
41*a*, 41*b*: First bridge means
42, 42*a*, 42*b*: Second bridge means
43: Support section
45: Through hole
46*a* to 46*f*: Connection portion
403, 404: Front end of connection portion
B8: Talus bone
B9: Calcaneal bone
J8: Subtalar joint
Mm: Medial malleolus

BEST MODE FOR CARRYING OUT THE INVENTION

The present invention will be understood more clearly from the following description of preferred embodiments taken in conjunction with the accompanying drawings. Note however that the embodiments and the drawings are merely illustrative, and the scope of the present invention shall be defined by the appended claims. In the accompanying drawings, like reference numerals denote like components throughout the plurality of figures.

Embodiments of the present invention will now be described with reference to the drawings.

Embodiment 1:

FIGS. 1 to 3, 4A, 5 and 6 show Embodiment 1.

Figure 2:
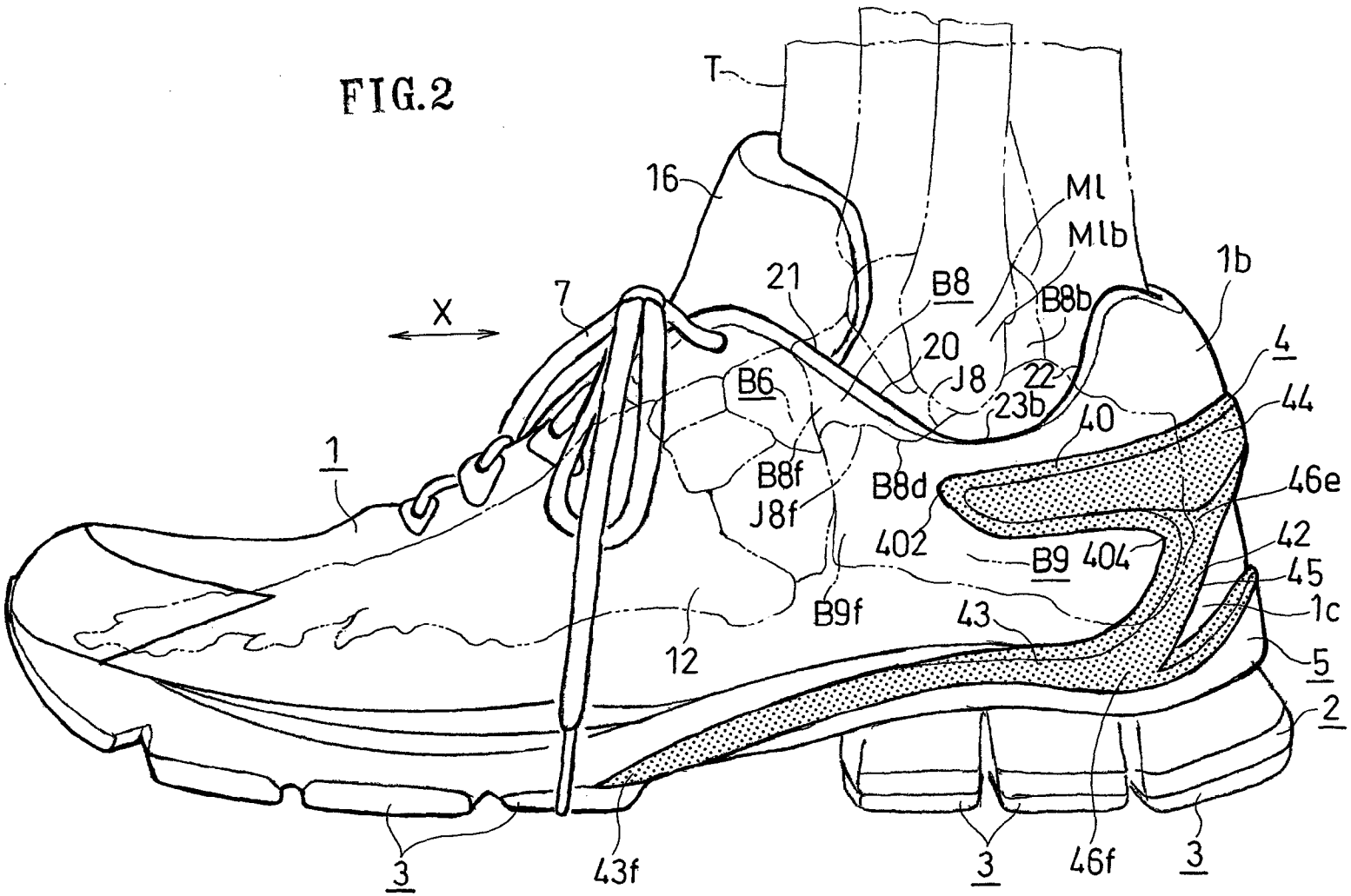
FIG. 2 is a lateral side view showing the athletic shoe of Embodiment 1.
Figure 3:
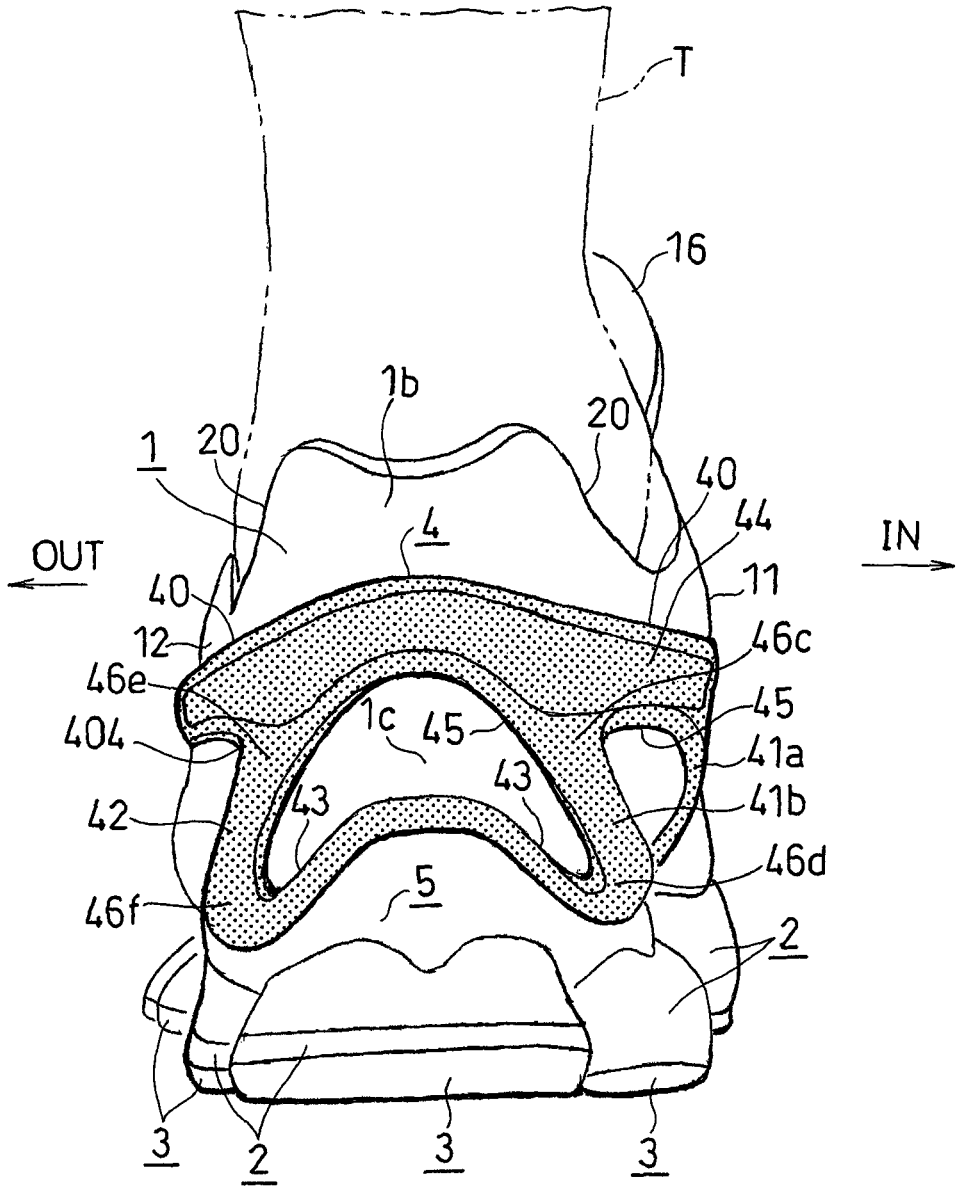
FIG. 3 is a back view showing the athletic shoe of Embodiment 1.

General Configuration:

As shown in FIGS. 1 to 3, the present athletic shoe includes an upper 1, a midsole 2, an outsole 3, and a heel counter 4.

Figure 4A:
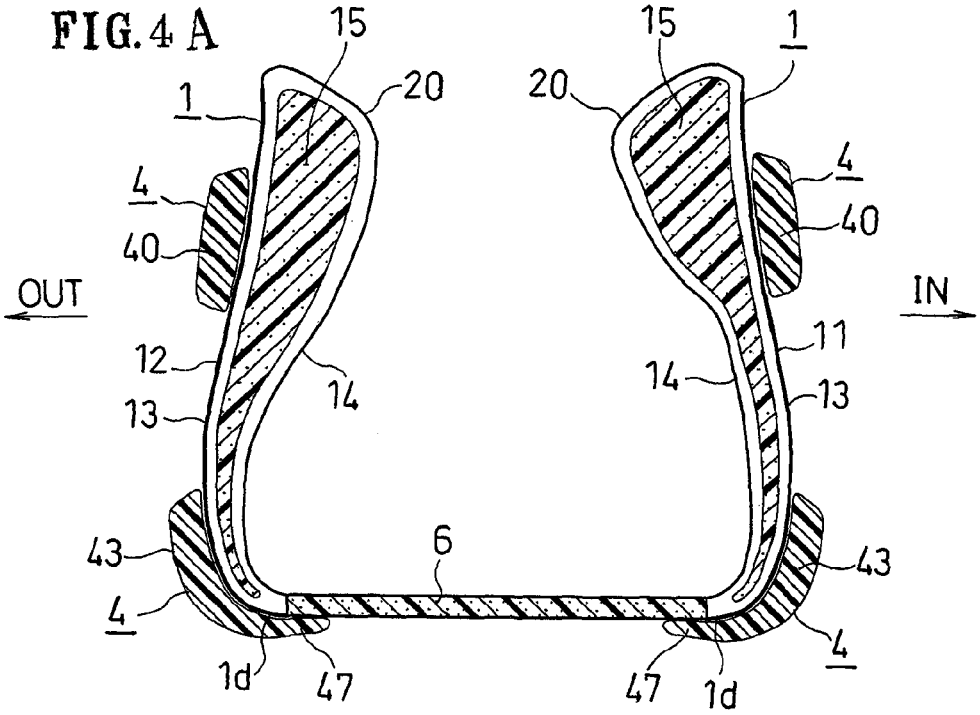
FIG. 4A is a cross-sectional view of an upper of Embodiment 1.

As shown in FIG. 4A, the upper 1 includes a cushion 15 made of a resin foam between a quarter 13 and a quarter lining 14. Note that the quarter 13 and the quarter lining 14 may each be formed by a plurality of layers of fabric.

An insole 6 is sewn onto the upper 1. On the other hand, as shown in FIG. 1, the upper 1 includes an opening (collar) 20 through which the leg T extends upward and through which the foot is inserted.

The upper 1 includes a fastening means (fastener) such as a shoelace 7, and the upper 1 is fastened by the shoelace 7 so that a medial side 11 of the upper 1 and a lateral side 12 of FIG. 2 are brought into close contact with the foot in the vicinity of the opening 20. Note that the reference numeral 16 denotes a tongue provided in front of the opening 20.

The medial side 11 of the upper 1 covers the medial surface of the foot, and the lateral side 12 of the upper 1 covers the lateral surface of the foot, with a back side 1*b* of the upper 1 covering the back surface of the foot. The medial side 11, the lateral side 12 and the back side 1*b* of the upper 1 together form the opening 20.

In the vicinity of the opening 20 of the upper 1, the medial side 11 of the upper 1 of FIG. 1 covers the front end portion B8*f* of the talus bone B8 and the front end portion J8*f* of the subtalar joint J8, and the lateral side 12 of the upper 1 of FIG. 2 covers the front end portion B8*f* of the talus bone B8 and the front end portion J8*f* of the subtalar joint J8. Note that in Embodiment 1, the lateral malleolus Ml and the medial malleolus Mm of FIG. 1 are each exposed above the opening 20.

As shown in FIG. 4A, the heel counter 4 is bonded and secured with no gap to the outer surface of the upper 1 on the medial side 11 and the lateral side 12 of the upper 1. The upper 1 with the heel counter 4 bonded to the outer surface thereof as described above has a high flexural rigidity and serves to suppress pronation.

The midsole 2 of FIG. 1, a heel cup 5 and the outsole 3 of FIG. 1 are stacked together below the heel counter 4 and the insole 6.

Note that the heel cup 5 supports the rear foot portion and the mid foot portion of the foot.

Heel Counter 4:

Next, the heel counter 4, which is an important part of the present invention, will be described.

The heel counter 4 shown in FIGS. 1 to 3 is bonded to, and exposed on, the outer surface of the fabric of the upper 1 to maintain the shape of a heel section 1*c* of the upper 1 which is formed by a plurality of layers of fabric and is soft. The heel counter 4 of Embodiment 1 shown in FIG. 5 includes a synthetic resin heel counter main part 48 and a synthetic resin reinforcement 44 bonded to the heel counter main part 48, and is formed as an integral part as shown in FIG. 6. The heel counter 4 is bonded to the heel cup 5.

As shown in FIGS. 1 and 2, the heel counter 4 is formed so that the medial side and the lateral side thereof are asymmetric with each other. The heel counter 4 includes a support section 43, a rib 40, and first bridge means 41*a* and 41*b* and second bridge means 42.

The support section 43 is provided along a lower edge 1*d* of the upper 1 (FIG. 4A). The rib 40 is provided generally parallel to the support section 43 at a position above the support section 43. The bridge means 41*a*, 41*b* and 42 each connect between the support section 43 and the rib 40.

Support Section 43:

On the medial side shown in FIG. 1, the support section 43 extends in a forward direction along the lower edge 1*d* of the medial side 11 of the upper 1 shown in FIG. 4A from the back side 1*b* of the upper 1 to the front end portion B8*f* of the talus bone B8. In Embodiment 1, it extends in a forward direction from the back side 1*b* of the upper 1 to a position under the navicular bone B6 as shown in FIG. 1.

On the other hand, on the lateral side shown in FIG. 2, the support section 43 extends in a forward direction along the lower edge 1*d* of the lateral side 12 of the upper 1 shown in FIG. 4A from the back side 1*b* of the upper 1 to the front end portion B8*f* of the talus bone B8. In Embodiment 1, it extends from the back side 1*b* of the upper 1 to a position that is forward of the position directly under the navicular bone B6 as shown in FIG. 2.

As shown in FIG. 3, the support section 43 extends as an integral member on the back side 1*b* of the upper 1.

Figure 5:
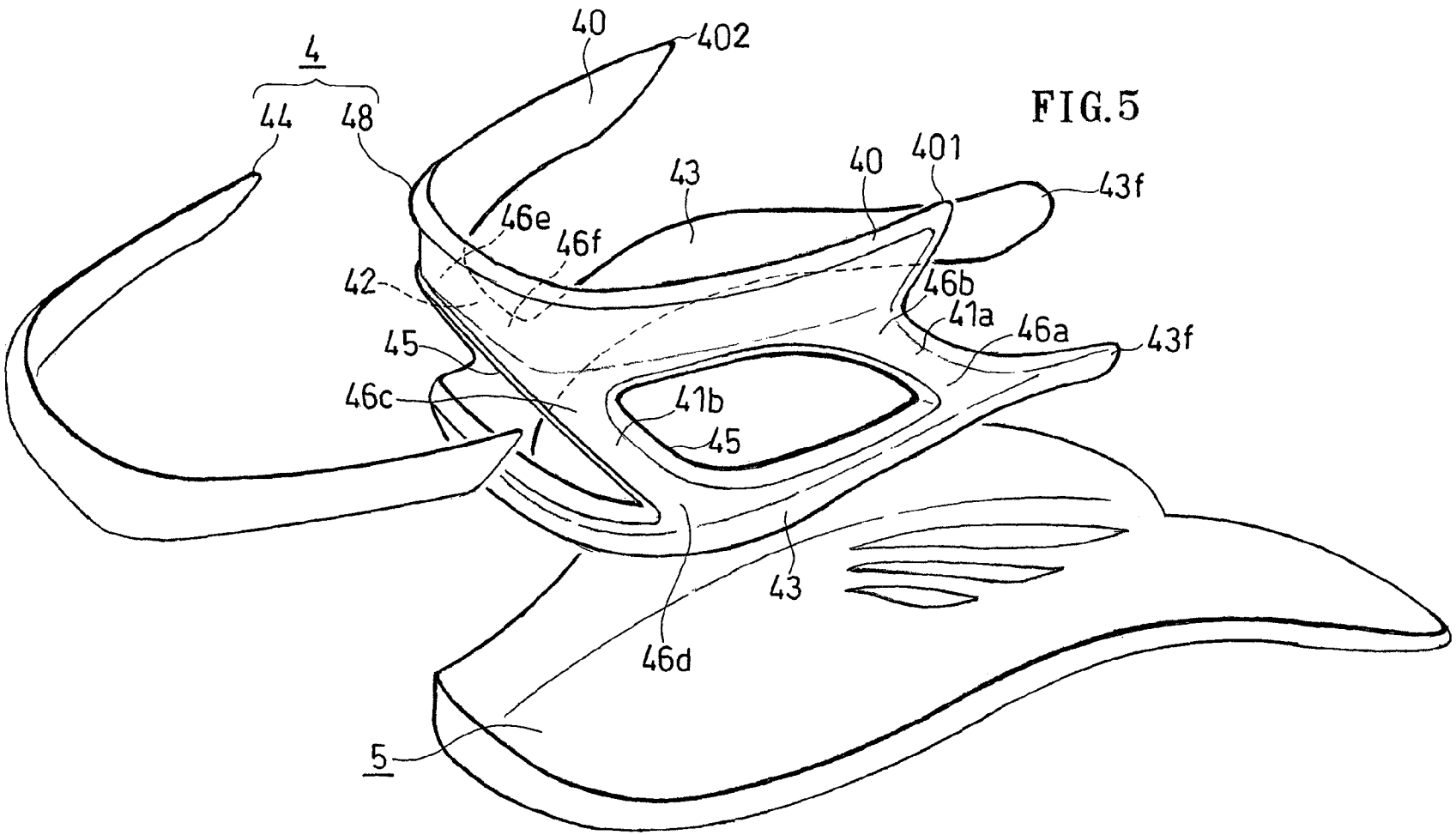
FIG. 5 is an exploded perspective view of a heel counter and a heel cup of Embodiment 1.
Figure 6:
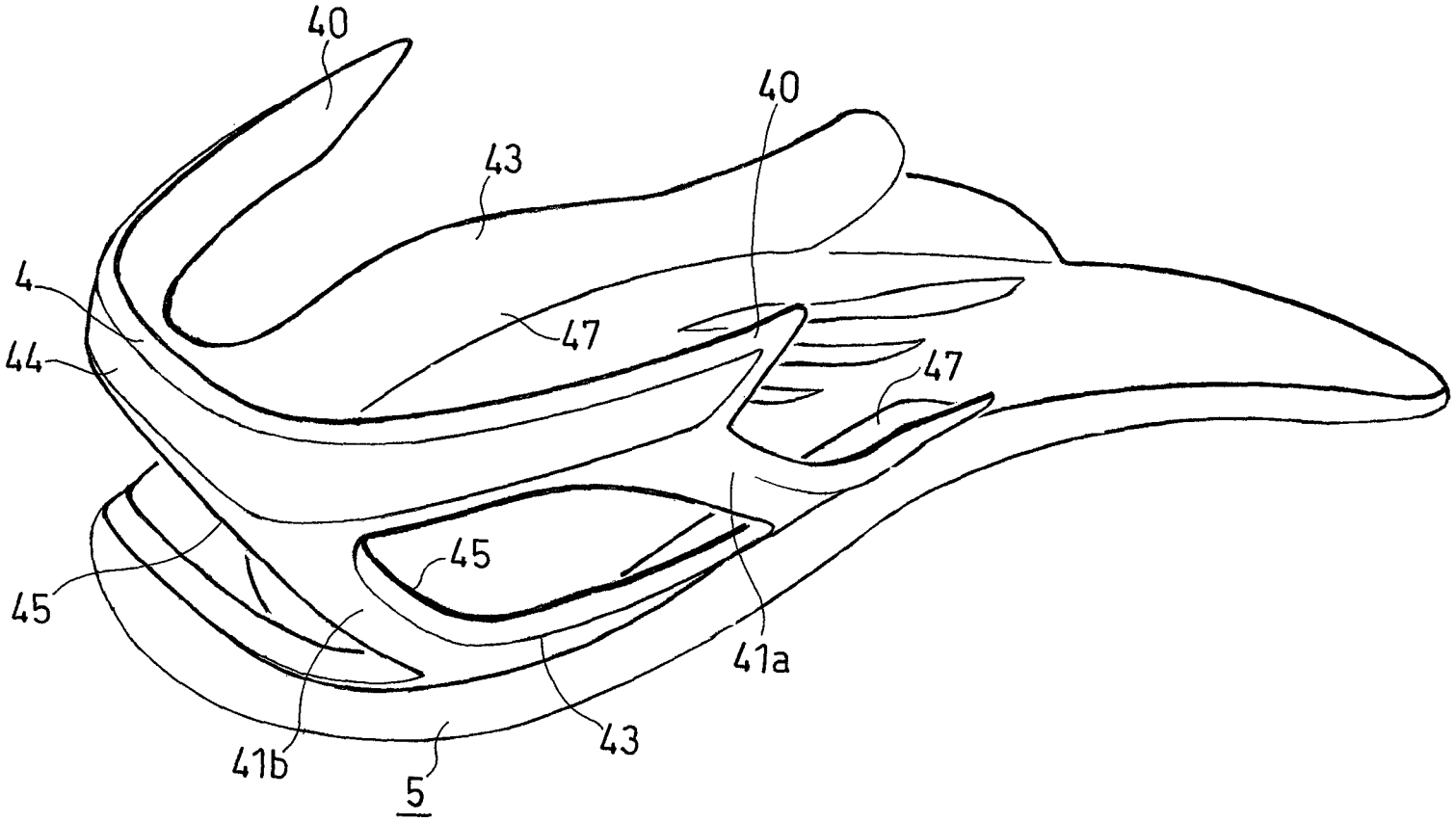
FIG. 6 is a perspective view of the heel counter and the heel cup of Embodiment 1.

As shown in FIGS. 1 and 2, a front end 43*f* of the support section 43 is located forward of the front end B9*f* of the calcaneal bone B9 and is located forward of front ends 401 and 402 of the rib 40 as shown in FIG. 5, on the medial/lateral side (IN/OUT in FIG. 3) of the foot.

Sandwiched Portion 47:

As described above, the midsole 2, the heel cup 5 and the outsole 3 of FIG. 1 are stacked together below the heel counter 4 and the insole 6 shown in FIG. 4A. The support section 43 includes a sandwiched portion 47 (FIG. 4A) integral therewith which is sandwiched between the upper 1 and the midsole 2.

Therefore, the heel counter 4 is secured to the upper 1 and the midsole 2 with the support section 43 sandwiched therebetween, and is bonded with no gap to the medial side 11 and the lateral side 12 of the upper 1 so that the heel counter 4 fits to the foot with the upper 1 interposed therebetween.

Rib 40:

As shown in FIGS. 1 and 2, the medial-side and lateral-side front ends 401 and 402 of the rib 40 are set so that they are at shorter distances to the opening 20 than to the support section 43.

On the medial side 11 shown in FIG. 1, the rib 40 extends in a forward direction on the outer surface of the medial side 11 generally in parallel to the support section 43 at a position above the support section 43 at least from the back side 1*b* of the upper 1 to a position directly under the rear end Mmb of the medial malleolus Mm.

In Embodiment 1, on the medial side 11, the rib 40 extends in a forward direction from the back side 1*b* of the upper 1 to a position directly under the vicinity of the center of the medial malleolus Mm in the front-rear direction X, as shown in FIG. 1.

Note that on the medial side 11, the rib 40 may extend in a forward direction from the back side 1*b* of the upper 1 to the vicinity of the navicular bone B6.

On the other hand, on the lateral side 12 shown in FIG. 2, the rib 40 extends in a forward direction on the outer surface of the lateral side 12 generally in parallel to the support section 43 at a position above the support section 43 at least from the back side 1*b* of the upper 1 to the rear end B8*b* of the talus bone B8.

In Embodiment 1, the rib 40 extends in a forward direction on the outer surface of the lateral side 12 from the back side 1*b* of the upper 1 to the front half portion of the talus bone B8, as shown in FIG. 2.

On the medial/lateral side of the foot, the rib 40 shown in FIGS. 1 and 2 covers the subtalar joint J8 or a portion of the calcaneal bone B9 in the vicinity of the subtalar joint J8. In Embodiment 1, on the medial/lateral side of the foot, the rib 40 covers a portion of the calcaneal bone under the subtalar joint J8, as shown in FIGS. 1 and 2.

As shown in FIG. 3, the rib 40 is formed as an integral member on the back side 1*b* of the upper 1. As shown in FIGS. 1 and 2, on the back side 1*b* of the upper 1, the rib 40 covers the back surface of an upper portion of the calcaneal bone B9, and extends toward the lower end B8*d* of the talus bone B8 on the medial side 11 and the lateral side 12.

Positional Relationship Between Rib 40 and Opening 20:

The upper edge of the medial side 11 of the upper 1 forming the opening 20 includes, connected together, a first edge 21 slanted upwardly as it extends in a forward direction from a medial-side middle point 23*a* of the opening 20 in the front-rear direction X, and a second edge 22 slanted upwardly as it extends in a rearward direction from the middle point 23*a*.

The upper edge of the lateral side 12 of the upper 1 forming the opening 20 includes, connected together, the first edge 21 slanted upwardly as it extends in a forward direction from a lateral-side middle point 23*b* of the opening 20 in the front-rear direction X, and the second edge 22 slanted upwardly as it extends in a rearward direction from the middle point 23*b*.

On the medial side 11, the rib 40 shown in FIG. 1 has the front end 401 at a position generally directly under or forward of the rear end Mmb of the medial malleolus Mm. In Embodiment 1, the rib 40 has the front end 401 at a position directly under the vicinity of the center of the medial malleolus Mm in the front-rear direction X as shown in FIG. 1.

On the medial side 11, the front end 401 of the rib 40 is located forward of the medial-side middle point 23*a* of the opening 20 and rearward of the front end portion B8*f* of the talus bone B8.

Note that since the medial malleolus Mm is located forward compared to the lateral malleolus MI, the medial-side middle point 23*a* shown in FIG. 1 is located forward compared to the lateral-side middle point 23*b* shown in FIG. 2.

First Bridge Means 41*a* and 41*b:*

As shown in FIGS. 1 and 3, on the medial side 11 of the upper 1, two first bridges (first bridge means) 41*a* and 41*b* are provided between the support section 43 and the rib 40. On the medial side 11 of the upper 1, the first bridges 41*a* and 41*b* connect the support section 43 and the rib 40 to each other, allowing the support section 43 to support the rib 40. The foremost one of these first bridges 41*a* and 41*b*, i.e., the first bridge 41*a*, is formed in a straight shape.

Formed between the two first bridges 41*a* and 41*b* is a through hole 45 through which the upper 1 is exposed.

On the medial side 11, the front end 401 of the rib 40 or the vicinity thereof is connected to the foremost first bridge 41*a* and is supported by the support section 43 via the first bridge 41*a*.

In Embodiment 1, the first bridge 41*a* is connected by means of a connection portion 46*b* in the vicinity of the front end 401 of the rib 40 and a lower part of the first bridge 41*a* is supported by the support section 43 by means of a connection portion 46*a*, as shown in FIG. 1.

Second Bridge Means 42:

On the lateral side 12 of the upper 1, a single second bridge (second bridge means) 42 is provided between the support section 43 and the rib 40, as shown in FIGS. 2 and 3. On the lateral side 12 of the upper 1, the second bridge 42 connects the support section 43 and the rib 40 to each other, allowing the support section 43 to support the rib 40.

As shown in FIGS. 1 to 3, the support section 43 and the rib 40 are connected to the bridges 41*a*, 41*b* and 42 by means of the connection portions 46*a* to 46*f*. Among the connection portions 46*b*, 46*c* and 46*e* connecting the rib 40 and the bridges 41*a*, 41*b* and 42 to each other, the foremost connection portion 46*b* is provided on the medial side 11 of the upper 1 shown in FIG. 1.

The foremost connection portion 46*b* is located forward at least of the rear end B8*b* of the talus bone B8. In Embodiment 1, the foremost connection portion 46*b* is for example located at a position directly under a position that is generally the center of the talus bone B8 in the front-rear direction X, as shown in FIG. 1.

On the other hand, the connection portions 46*a*, 46*d* and 46*f* of the bridges 41*a*, 41*b* and 42 on the side of the support section 43 are located forward of the connection portions 46*b*, 46*c* and 46*e* on the side of the rib 40, as shown in FIGS. 1 and 2.

Therefore, the first and second bridges 41*a*, 41*b* and 42 are each formed in a shape that is slanted so that the upper end thereof is located rearward of the lower end thereof.

A front end 403 of the medial-side connection portion 46*b* is located forward compared to a front end 404 of the lateral-side connection portion 46*e*, as shown in FIGS. 1 and 2. In the present embodiment, the front end 403 of the medial-side connection portion 46*b* is located forward of the medial-side middle point 23*a* of the opening, whereas the front end 404 of the lateral-side connection portion 46*e* is located rearward of the lateral-side middle point 23*b* of the opening.

For example, the medial-side front end 403 is located forward of the center of the calcaneal bone B9 in the front-rear direction X, as shown in FIG. 1. On the other hand, the lateral-side front end 404 is located in the vicinity of the rear end of the calcaneal bone B9, as shown in FIG. 2.

Note that the medial-side middle point 23*a* of the opening is normally located slightly forward compared to the lateral-side middle point 23*b*. The height (level) of the medial-side middle point 23*a* is higher than that of the lateral-side middle point 23*b*.

Next, other embodiments will be described. The description of the following embodiments will chiefly focus on what are different from Embodiment 1 described above.

Figure 4B:
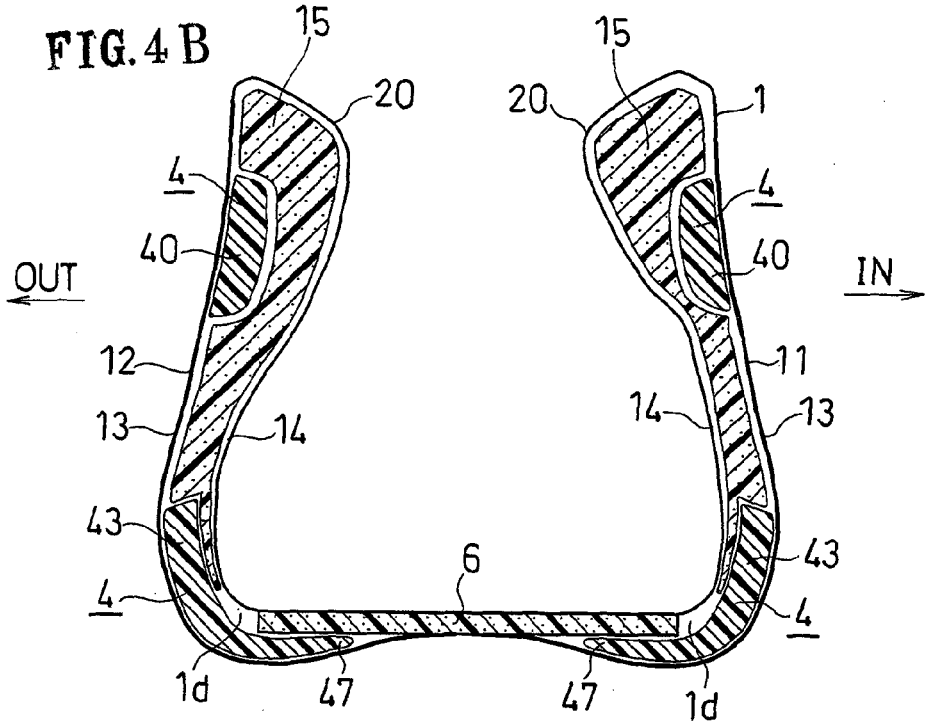
FIG. 4B is a cross-sectional view of an upper of Embodiment 2.

Embodiment 2:

FIG. 4B shows Embodiment 2.

As shown in FIG. 4B, the heel counter 4 is bonded to the medial side 11, the back side 1*b* and the lateral side 12 inside the upper 1. In this case, the heel counter 4 is bonded to the quarter 13. The rib 40 bonded to the quarter 13 increases the flexural rigidity of the upper 1.

Note that the midsole 2, the heel cup 5 and the outsole 3 of FIG. 1 are stacked together below the heel counter 4 and the insole 6.

Embodiment 3:

FIGS. 7 to 10 show Embodiment 3.

Figure 7:
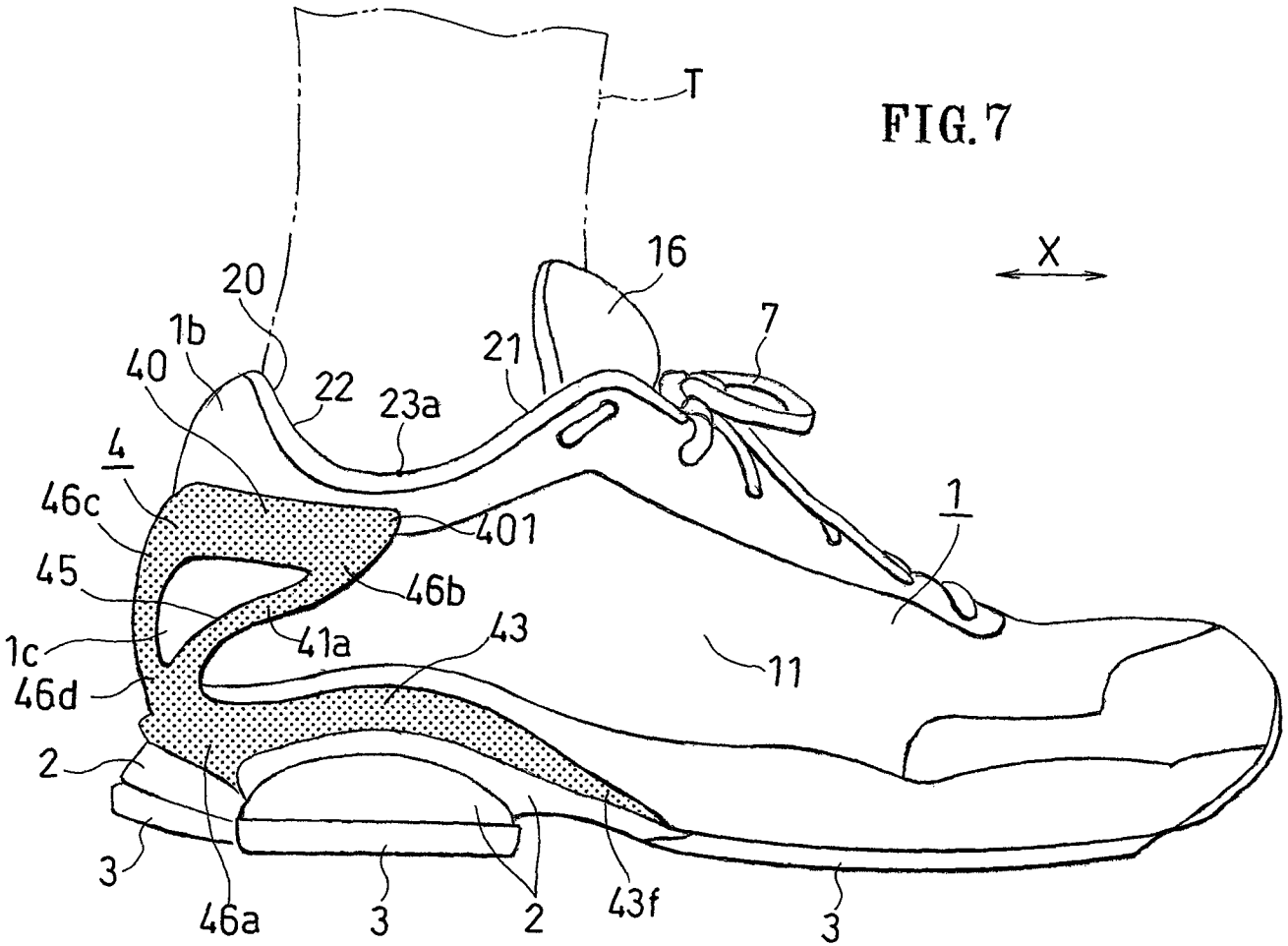
FIG. 7 is a medial side view showing an athletic shoe of Embodiment 3.
Figure 8:
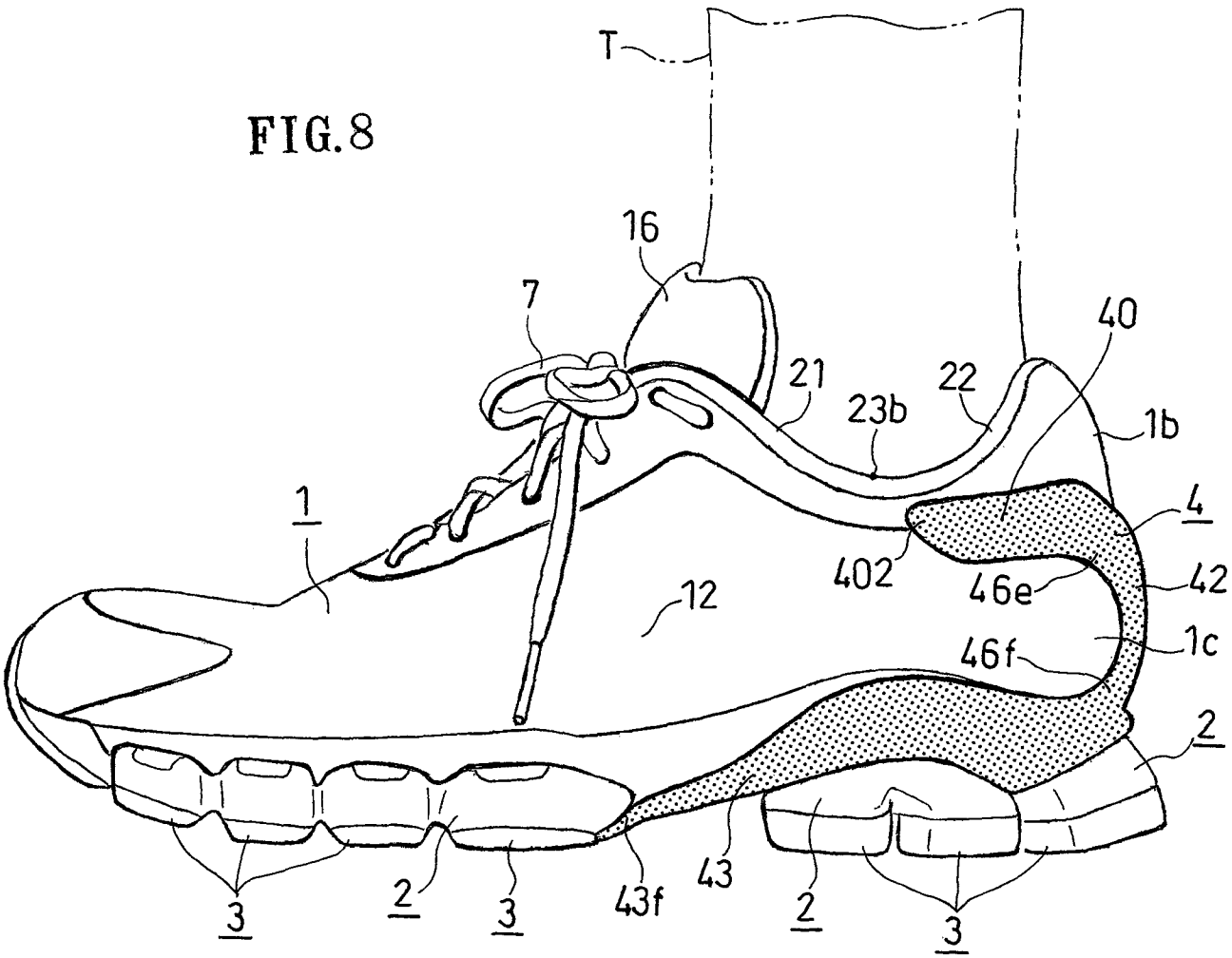
FIG. 8 is a lateral side view showing the athletic shoe of Embodiment 3.
Figure 9:
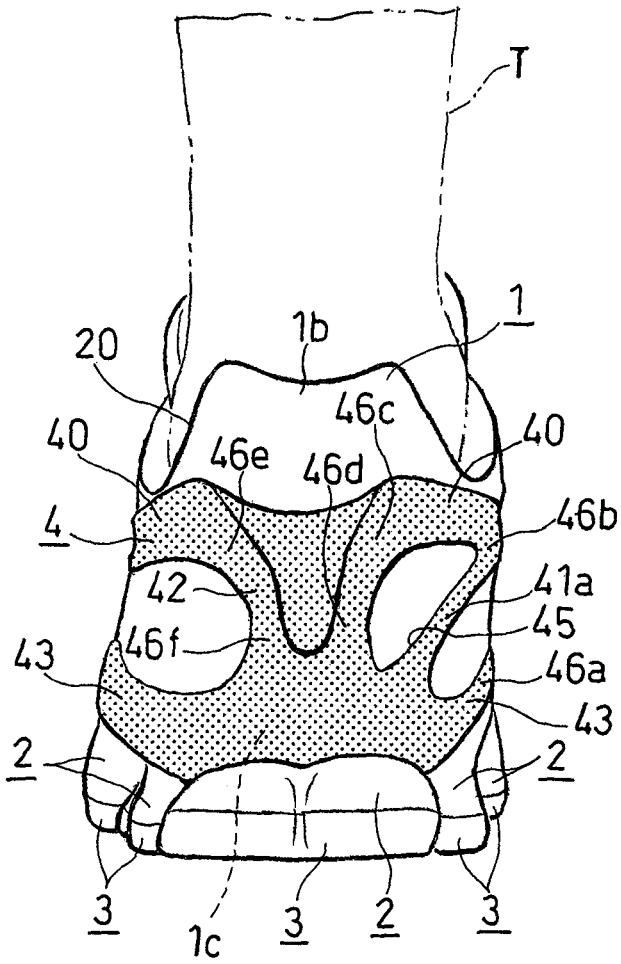
FIG. 9 is a back view showing the athletic shoe of Embodiment 3.

As shown in FIGS. 7 to 9, the heel counter 4 of Embodiment 3 includes the first and second bridges 41*a* and 42.

As shown in FIG. 7, on the medial side 11 of the upper 1, the front first bridge 41*a* is formed in a curved shape extending in a curved pattern from the front end 401 toward a position under the vicinity of the rear end portion of the calcaneal bone B9 (FIG. 1).

As shown in FIG. 9, the second bridge 42 is located at the center of the back side 1*b* of the upper 1.

Figure 10:
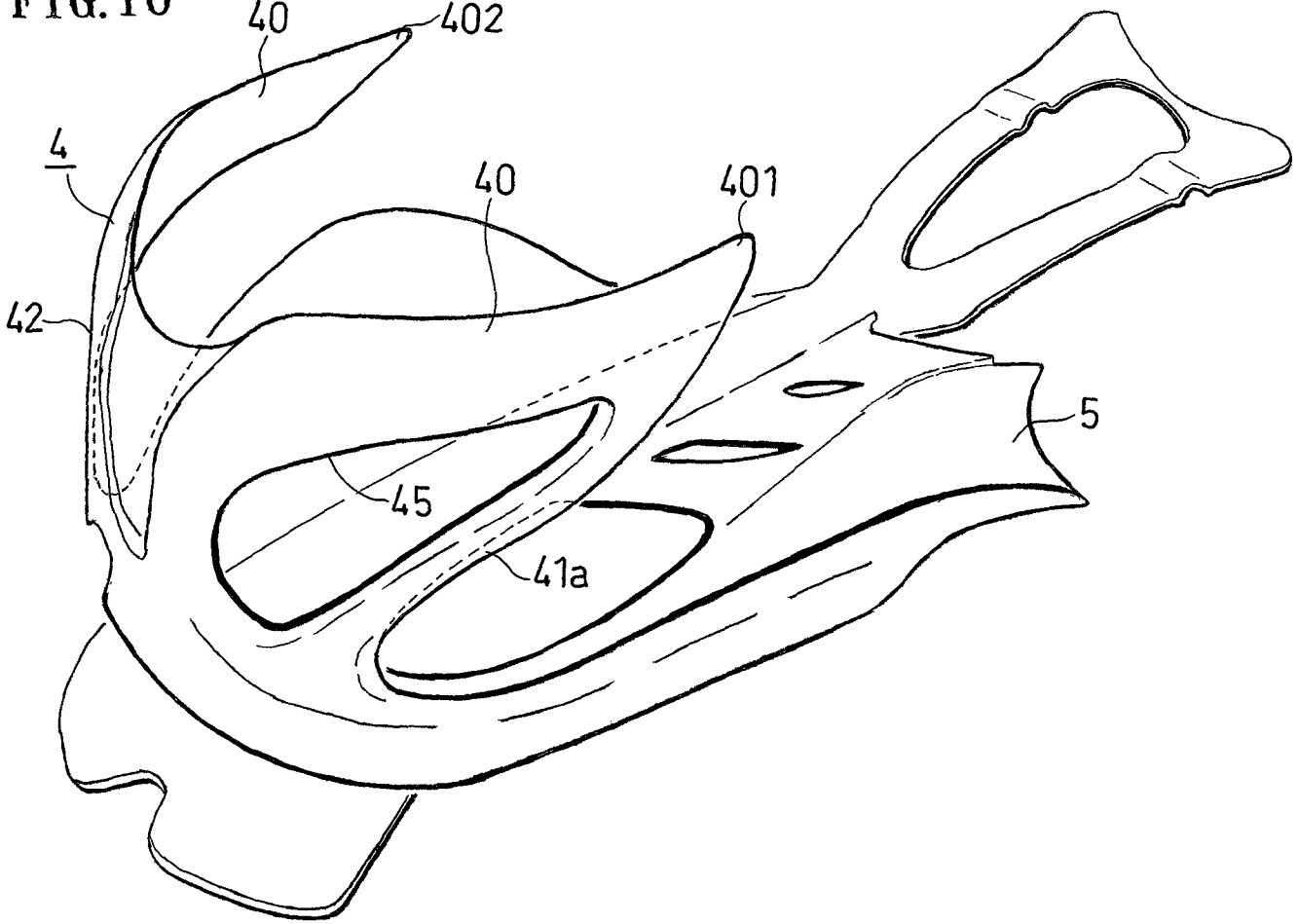
FIG. 10 is a perspective view showing a heel counter of Embodiment 3.

Note that as shown in FIG. 10, the heel counter 4 is formed integral with the heel cup 5. The heel cup 5 supports the rear foot portion and the mid foot portion.

Figure 11A:
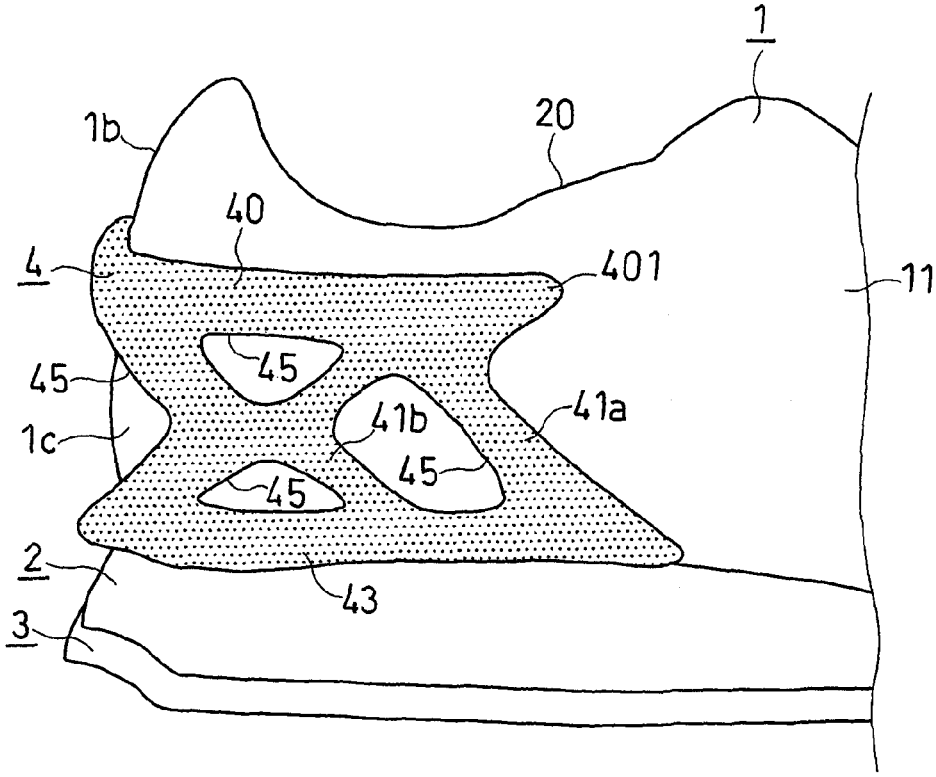
FIG. 11A is a medial side view showing a rear foot portion of an athletic shoe of Embodiment 4.
Figure 11B:
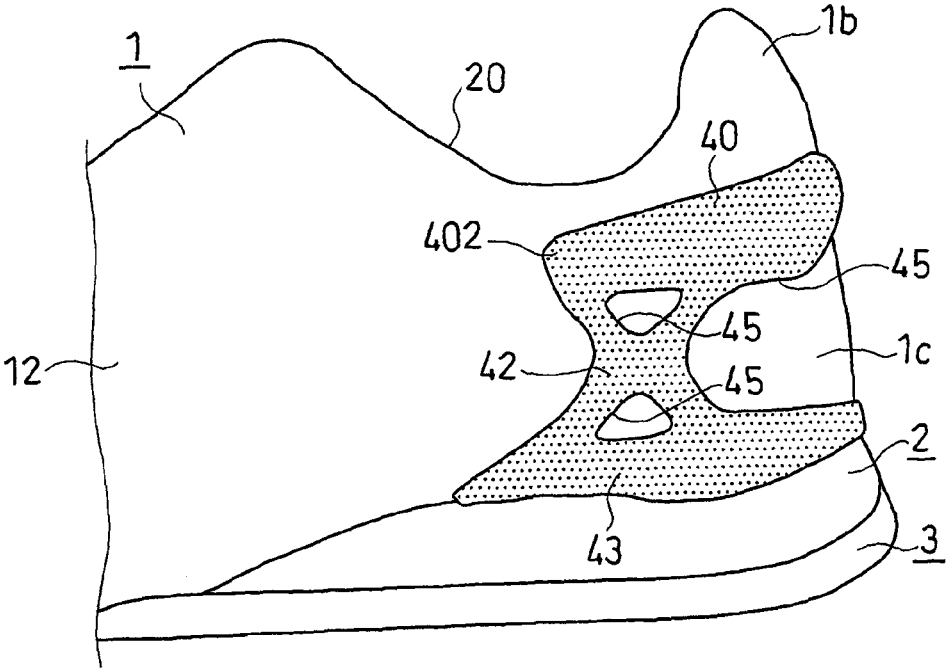
FIG. 11B is a lateral side view showing the rear foot portion of the athletic shoe of Embodiment 4.

Embodiment 4:

FIGS. 11A and 11B show Embodiment 4.

As shown in FIG. 11A, on the medial side 11 of the upper 1, the foremost first bridge 41*a* is formed in a straight shape. On the other hand, the rear first bridge 41*b* is formed in an X-letter shape.

As shown in FIG. 11B, on the lateral side 12 of the upper 1, the second bridge 42 is formed in an X-letter shape. The heel counter 4 is formed in a lattice pattern with a plurality of through holes 45 by the support section 43, the rib 40 and the first and second bridges 41*a*, 41*b* and 42.

Figure 12A:
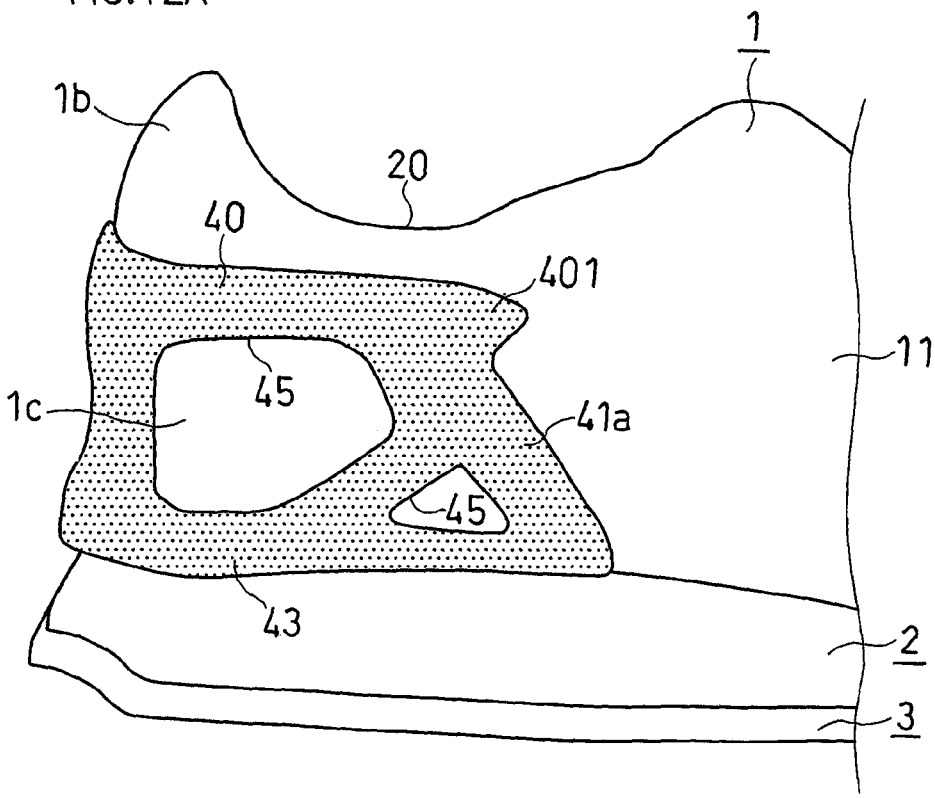
FIG. 12A is a medial side view showing a rear foot portion of an athletic shoe of Embodiment 5.
Figure 12B:
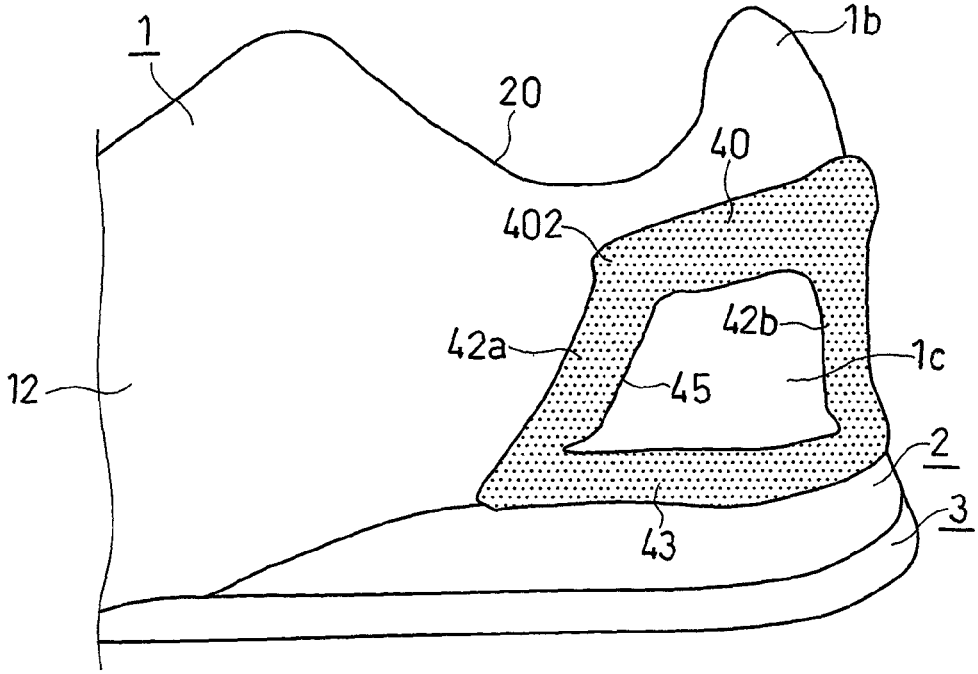
FIG. 12B is a lateral side view showing the rear foot portion of the athletic shoe of Embodiment 5.

Embodiment 5:

FIGS. 12A and 12B show Embodiment 5.

As shown in FIG. 12A, on the medial side 11 of the upper 1, the front first bridge 41*a* is formed in an inverted Y-letter shape.

As shown in FIG. 12B, on the lateral side 12 of the upper 1, second bridges 42*a* and 42*b* are formed between the support section 43 and the rib 40.

Figure 13A:
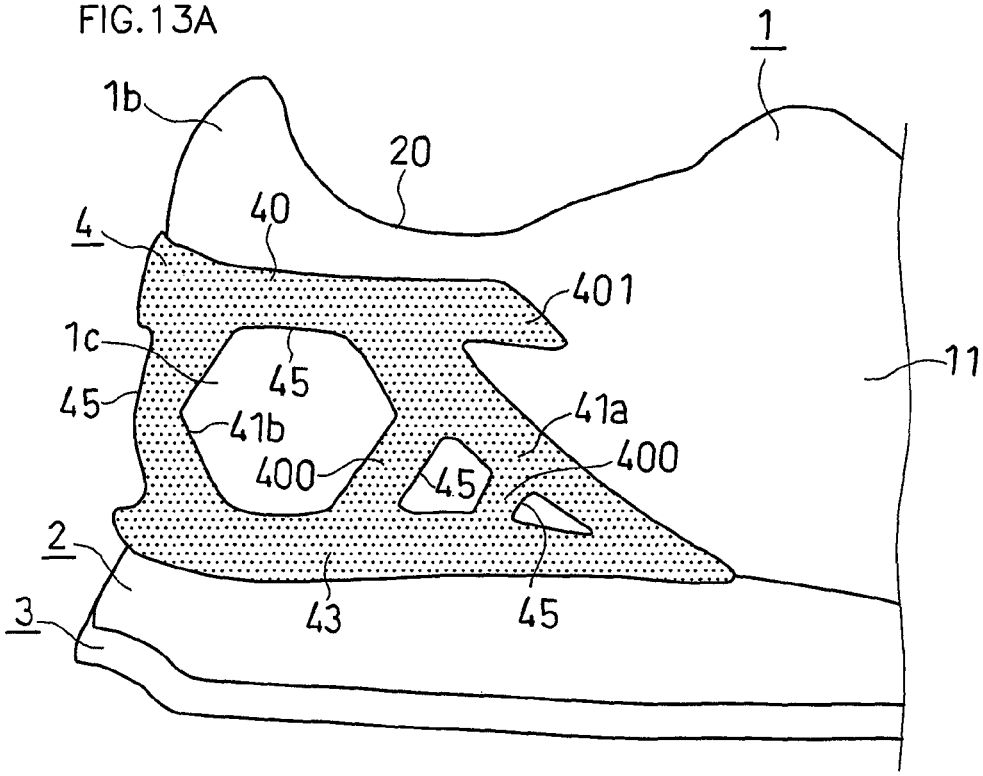
FIG. 13A is a medial side view showing a rear foot portion of an athletic shoe of Embodiment 6.
Figure 13B:
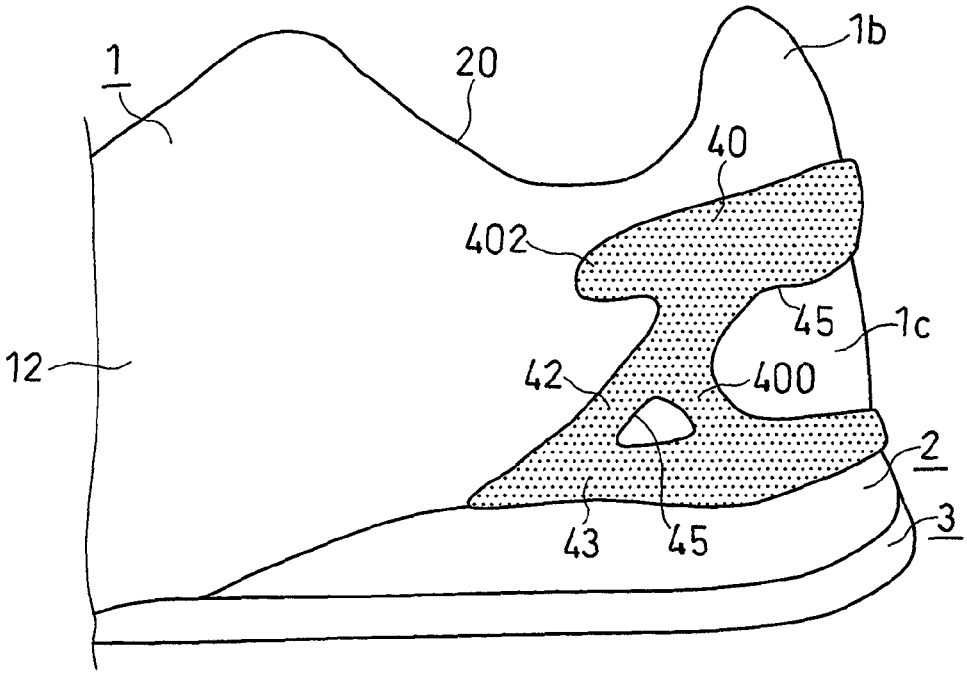
FIG. 13B is a lateral side view showing the rear foot portion of the athletic shoe of Embodiment 6.

Embodiment 6:

FIGS. 13A and 13B show Embodiment 6.

As shown in FIG. 13A, on the medial side 11 of the upper 1, the front first bridge 41*a* includes a main portion extending in a diagonally forward direction from the front portion of the rib 40 to the front end portion of the support section 43, and two branch portions 400 extending in a diagonally rearward direction from the main portion to the support section 43.

Similarly, as shown in FIG. 13B, on the lateral side 12 of the upper 1, the second bridge 42 includes a main portion extending in a diagonally forward direction from the front portion of the rib 40 to the front end portion of the support section 43, and a branch portion 400 extending in a diagonally rearward direction from the main portion to the support section 43.

While preferred embodiments have been described above with reference to the drawings, various obvious changes and modifications will readily occur to those skilled in the art upon reading the present specification.

For example, the heel cup may be absent. The portion of the foremost connection portion other than the front end thereof may be located rearward of the position directly under the rear end of the medial malleolus. In the embodiment of FIG. 1, another first bridge may be further provided for connecting the connection portion 46*b* and the connection portion 46*d* to each other.

Thus, such changes and modifications are deemed to fall within the scope of the present invention, which is defined by the appended claims.

INDUSTRIAL APPLICABILITY

The present invention is applicable to athletic shoes.

The invention claimed is:

1. An athletic shoe with a heel counter for maintaining a shape of a heel section of an upper, wherein:

the upper is formed by layering together a plurality of layers of a material;

the upper includes a medial side covering a medial surface of a foot, a lateral side covering a lateral surface of the foot, a back side covering a back surface of the foot, and an opening defined by upper edges of the medial side, the lateral side and the back side;

in a vicinity of the opening of the upper, the medial side of the upper covers a front end portion of a talus bone and a front end portion of a subtalar joint, and the lateral side of the upper covers the front end portion of the talus bone and the front end portion of the subtalar joint;

the heel counter is formed as an integral synthetic resin part, the heel counter comprising:

a support section extending in a forward direction of the foot along a lower edge of the medial side of the upper from the back side of the upper to a position forward of a rear end of the talus bone, and extending in the forward direction along a lower edge of the lateral side of the upper from the back side of the upper to a position forward of the rear end of the talus bone;

a rib extending in the forward direction along the medial side generally in parallel to the support section at a position above the support section from the back side of the upper to a position forward of a position directly under a rear end of a medial malleolus, and extending in the forward direction along the lateral side generally in parallel to the support section at a position above the support section from the back side of the upper to a position forward of the rear end of the talus bone;

one or more first bridge means provided on the medial side so as to bridge between the support section and the rib; and one or more second bridge means provided on the back side or the lateral side so as to bridge between the support section and the rib, wherein:

the first and second bridge means, the support section and the rib form at least a through hole therebetween through which the upper is exposed;

a foremost one of a plurality of connection portions by which the rib and each of the bridge means are connected to each other is provided on the medial side of the upper; and a front end of the foremost connection portion is located forward of a position directly under the rear end of the medial malleolus.

2. An athletic shoe according to claim 1, wherein the rib on the back side covers a back side of an upper portion of a calcaneal bone, and the rib on the medial side and the lateral side extends toward a lower end of the talus bone.

3. An athletic shoe according to claim 1, wherein the rib on the medial side and the lateral side covers a portion of a calcaneal bone in a vicinity of the subtalar joint.

4. An athletic shoe according to claim 3, wherein a front end of the rib or a vicinity thereof is connected to the first bridge means on the medial side, and the rib is supported by the support section via the first bridge means.

5. An athletic shoe according to claim 4, wherein a medial-side front end of the rib is located forward compared to a lateral-side front end of the rib.

6. An athletic shoe according to claim 4, wherein the heel counter further includes a sandwiched portion connected to the support section and sandwiched between the upper and a shoe sole.

7. An athletic shoe according to claim 6, wherein on the medial side and the lateral side, a front end of the support section is located forward of a front end of the calcaneal bone and is located forward of the front end of the rib.

8. An athletic shoe according to claim 1, wherein:

the medial-side and lateral-side upper edges of the upper forming the opening are each formed of a first edge slanted upwardly as it extends in a forward direction from a middle point of the opening in a front-rear direction and a second edge slanted upwardly as it extends in a rearward direction from the middle point, the first and second edges are connected together; and a medial-side front end of the rib is located forward of the middle point and rearward of the front end of the talus bone.

9. An athletic shoe according to claim 1, wherein the heel counter is attached to an outer surface of the upper.

10. An athletic shoe with a heel counter for maintaining a shape of a heel section of an upper, wherein:

the upper is formed by layering together a plurality of layers of a material;

the upper includes a medial side covering a medial surface of a foot, a lateral side covering a lateral surface of the foot, a back side covering a back surface of the foot, and an opening defined by upper edges of the medial side, the lateral side and the back side, wherein the medial side of the upper covers a front end portion of a talus bone and a front end portion of a subtalar joint, and the lateral side of the upper covers the front end portion of the talus bone and the front end portion of the subtalar joint;

the heel counter is formed as an integral synthetic resin part, the heel counter comprising:

a support section extending in a forward direction of the foot along a lower edge of the medial side of the upper from the back side of the upper to a position forward of a rear end of the talus bone, and extending in the forward direction along a lower edge of the lateral side of the upper from the back side of the upper to a position forward of the rear end of the talus bone;

a rib extending in the forward direction along the medial side at a position above the support section from the back side of the upper to a position forward of a position directly under a rear end of a medial malleolus, and extending in the forward direction along the lateral side at a position above the support section from the back side of the upper to a position forward of the rear end of the talus bone, wherein a medial-side front end and a lateral-side front end of the rib are at shorter distances to the opening than to the support section;

one or more first bridge means provided on the medial side so as to bridge between the support section and the rib; and one or more second bridge means provided on the back side or the lateral side so as to bridge between the support section and the rib, wherein:

the first and second bridge means, the support section and the rib form at least a through hole therebetween through which the upper is exposed;

a foremost one of a plurality of connection portions by which the rib and the bridge means are connected to each other is provided on the medial side of the upper; and a front end of the foremost connection portion is located forward of a position directly under the rear end of the medial malleolus.

* * * * *